US011306929B2

(12) United States Patent
Pease et al.

(10) Patent No.: US 11,306,929 B2
(45) Date of Patent: Apr. 19, 2022

(54) PORTABLE STEAM HUMIDIFIER

(71) Applicant: Vornado Air LLC, Andover, KS (US)

(72) Inventors: Gregory Pease, Andover, KS (US); Brian M. Cartwright, Wichita, KS (US); Cooper Phillips, Wichita, KS (US)

(73) Assignee: Vornado Air, LLC, Andover, KS (US)

( * ) Notice: Subject to any disclaimer, the term of this patent is extended or adjusted under 35 U.S.C. 154(b) by 0 days.

(21) Appl. No.: 16/565,296

(22) Filed: Sep. 9, 2019

(65) Prior Publication Data

US 2020/0080734 A1 Mar. 12, 2020

Related U.S. Application Data

(60) Provisional application No. 62/728,808, filed on Sep. 9, 2018.

(51) Int. Cl.

| | |
|---|---|
| ***F24F 6/02*** | (2006.01) |
| ***B01F 3/02*** | (2006.01) |
| ***B01F 15/06*** | (2006.01) |
| ***B01F 5/00*** | (2006.01) |

(52) U.S. Cl.

CPC ..... *F24F 6/025* (2013.01); *B01F 3/022* (2013.01); *B01F 5/0057* (2013.01); *B01F 15/066* (2013.01); *B01F 2015/062* (2013.01); *B01F 2215/0091* (2013.01)

(58) Field of Classification Search

CPC ..... B01F 3/022; B01F 5/0057; B01F 15/066; B01F 2015/062; B01F 2215/0091; F24F 6/025

USPC ..... 261/142, 79.2

See application file for complete search history.

(56) References Cited

U.S. PATENT DOCUMENTS

| | | | | |
|---|---|---|---|---|
| 3,901,443 | A | 8/1975 | Mitsui et al. | |
| 3,970,250 | A | 7/1976 | Drews | |
| 3,990,427 | A | 11/1976 | Clinebell | |
| 4,810,854 | A | 3/1989 | Jursich et al. | |
| 5,111,529 | A * | 5/1992 | Glucksman | F24F 6/025 392/394 |
| 5,131,070 | A | 7/1992 | Chiu et al. | |
| 5,354,515 | A | 10/1994 | Ushimaru | |
| 5,397,510 | A | 3/1995 | Clark | |
| 5,483,616 | A | 1/1996 | Chiu et al. | |
| 5,485,828 | A | 1/1996 | Hauser | |
| 5,529,726 | A | 6/1996 | Glenn | |
| 5,624,608 | A | 4/1997 | Ching et al. | |
| 6,053,482 | A | 4/2000 | Glenn et al. | |
| 6,135,427 | A | 10/2000 | Tsai | |
| 6,226,451 | B1 * | 5/2001 | Wong | F24F 6/025 261/142 |

(Continued)

*Primary Examiner* — Charles S Bushey

(57) ABSTRACT

The present invention provides an improved portable steam humidifier. According to a preferred embodiment, the improved humidifier of the present invention preferably includes a spiral mixing chamber connected to a steam chamber, a spiral outlet duct, an inlet duct and an outlet grill. According to a preferred embodiment, the inlet duct preferably receives air from an inlet fan and directs the air into the spiral mixing chamber where the air is mixed with water vapor from the steam chamber. According to a further preferred embodiment, the air is further directed from the spiral mixing chamber through the spiral outlet duct out through the outlet grill.

23 Claims, 7 Drawing Sheets

(56) References Cited

U.S. PATENT DOCUMENTS

| | | | | |
|---|---|---|---|---|
| 6,244,576 | B1 | 6/2001 | Tsai | |
| 6,314,237 | B1 * | 11/2001 | Glucksman | A47J 27/04 219/433 |
| 6,477,322 | B1 * | 11/2002 | Crowhurst | B01D 1/0017 392/394 |
| 6,511,050 | B2 | 1/2003 | Chu | |
| 6,591,061 | B2 | 7/2003 | Wang | |
| 6,715,739 | B2 | 4/2004 | Mulvaney et al. | |
| 7,350,773 | B2 * | 4/2008 | French | F24F 6/02 261/79.2 |
| 7,377,493 | B2 | 5/2008 | Thomas | |
| 7,810,742 | B2 | 10/2010 | Levi | |
| 9,440,240 | B2 | 9/2016 | Mills et al. | |
| 2003/0051886 | A1 | 3/2003 | Adiga et al. | |
| 2003/0206731 | A1 * | 11/2003 | Glucksman | F24F 6/18 392/405 |
| 2004/0084787 | A1 | 5/2004 | Williams et al. | |
| 2005/0169615 | A1 | 8/2005 | Glucksman | |
| 2006/0115388 | A1 | 6/2006 | Sanderson | |
| 2011/0250978 | A1 | 10/2011 | O'Neill | |
| 2016/0082220 | A1 * | 3/2016 | Barker | B01F 15/00207 128/203.12 |
| 2017/0197056 | A1 * | 7/2017 | Van Schalkwyk | A61M 16/024 |
| 2017/0197057 | A1 * | 7/2017 | Osborne | A61M 16/109 |
| 2018/0361106 | A1 * | 12/2018 | Kuriger | A61M 16/161 |
| 2019/0101301 | A1 * | 4/2019 | Ediger | F24F 6/025 |

* cited by examiner

PORTABLE STEAM HUMIDIFIER

RELATED APPLICATIONS

The present application claims priority to U.S. Provisional Application No. 62/728,808, filed Sep. 9, 2018, which is hereby incorporated by reference herein.

FIELD OF INVENTION

The present invention is related in general to an improved humidifier design, and in particular, to an improved portable steam humidifier.

BACKGROUND OF THE INVENTION

A humidifier is a device that increases humidity (moisture) in a given space by circulating air with high moisture content. In the home, point-of-use humidifiers are commonly used to humidify a single room, while whole-house or furnace humidifiers, which connect to a home's HVAC system, provide humidity to the entire house. A "portable" humidifier may range in size from a small tabletop appliance to a large floor-mounted unit. The water is usually supplied by manually filling the unit on a periodic basis.

Vaporizers (also known as steam humidifiers or warm mist humidifiers) are a type of humidifier which heats or boils water, releasing steam and moisture into the air. A medicated inhalant can also be added to the steam vapor to help reduce coughs. Vaporizers may be more healthful than cool mist types of humidifiers because steam is less likely to convey mineral impurities or microorganisms from the standing water in the reservoir. However, boiling water requires significantly more energy than other techniques. Still further, the boiling of water often leaves behind mineral deposits which can cause inefficiencies and breakdowns in the water/heating systems of the vaporizer. Accordingly, common vaporizer designs are prone to excessive maintenance issues. Additionally, the vaporizers of the prior art are often loud and obtrusive during water heating. The resulting noise of these vaporizers causes them to be very inconvenient for use next to beds or other situations where quiet operation is preferred.

Accordingly, what is needed is an improved vaporizer/steam humidifier design which overcomes the limitations of the prior art. In particular, what is needed is a clean, efficient, safe and quiet vaporizer to use in a variety of settings.

SUMMARY OF THE DISCLOSURE

To minimize the limitations of the prior art, and to minimize other limitations that will be apparent upon the reading of the specifications, the preferred embodiment of the present invention provides an improved portable steam humidifier.

According to a preferred embodiment, the improved humidifier of the present invention preferably includes a spiral mixing chamber connected to a steam chamber, a spiral outlet duct, an inlet duct and an outlet grill. According to a further preferred embodiment, the inlet duct preferably receives air from an inlet fan and directs the air into the spiral mixing chamber where the air is mixed with water vapor from the steam chamber. According to a further preferred embodiment, the air is further directed from the spiral mixing chamber through the spiral outlet duct and out through the outlet grill.

According to a further preferred embodiment, the air humidifying system of the present invention preferably further includes a water heating assembly having a boiler pod, a boiler pod cover, a bonnet and a boiler pod gasket. According to a further preferred embodiment, the boiler pod of the present invention is preferably secured above the trough reservoir.

According to a further preferred embodiment, the air humidifying system of the present invention preferably further includes a base assembly which supports the water tank and the vapor blower assembly of the present invention.

These and other advantages and features of the present invention are described with specificity in the descriptions below so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness. It should be understood that the scope of the present invention is intended to be limited solely by the appended claims.

FIG. 2 shows back perspective view of the of the exemplary humidifier shown in

FIG. 1.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized, and changes may be made without departing from the scope of the present invention.

Further, various inventive features are described below that can each be used independently of one another or in combination with other features. However, any single inventive feature may not address any of the problems discussed above or only address one of the problems discussed above.

Further, one or more of the problems discussed above may not be fully addressed by any of the features described below.

Figure 1:
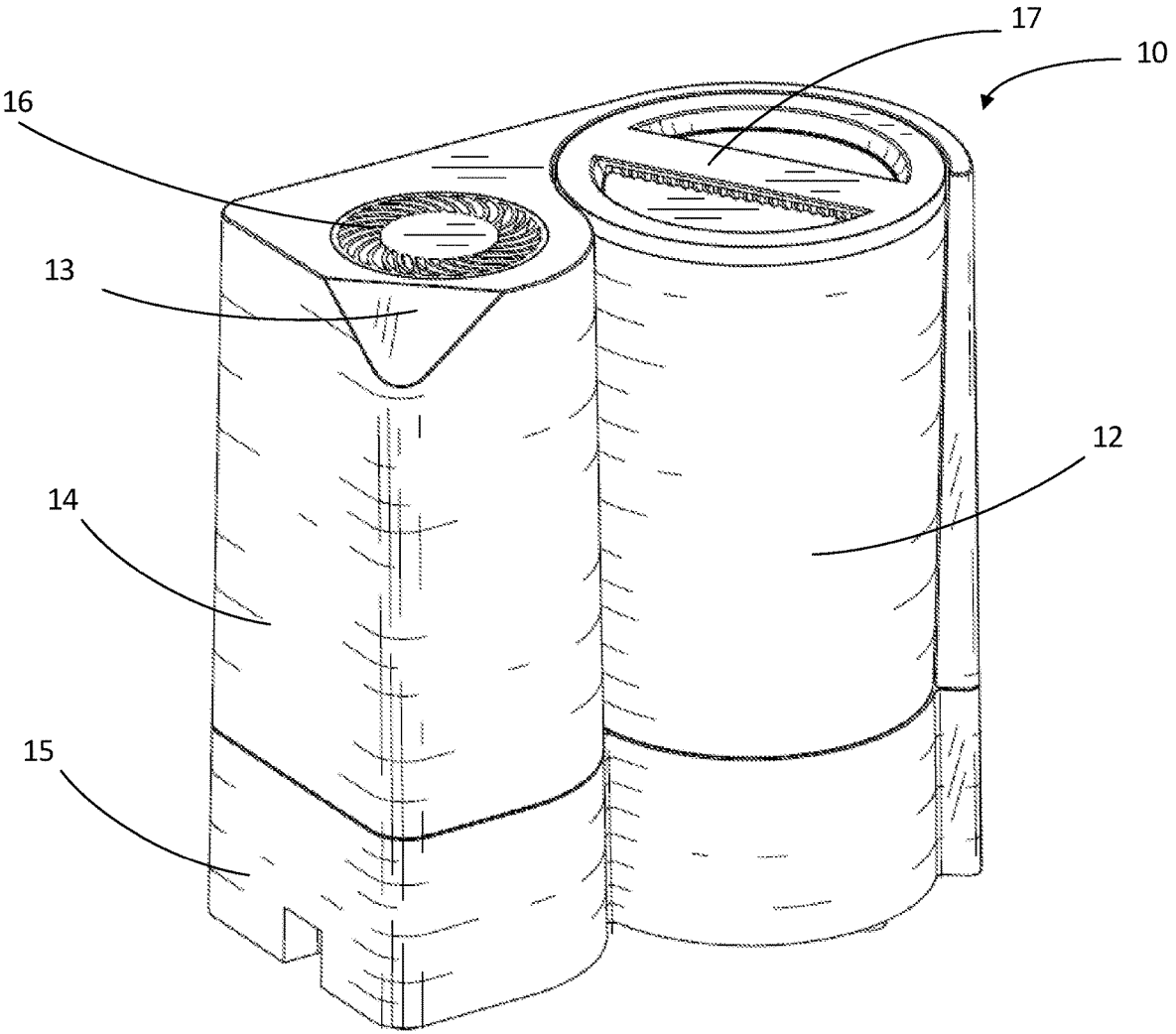
FIG. 1 shows a front perspective view of a humidifier in accordance with a first preferred embodiment of the present invention.

FIG. 1 illustrates a front view of a humidifier 10 in accordance with a first preferred embodiment of the present invention. As shown in FIG. 1, the humidifier 10 preferably includes a tank 12 and a vapor blower assembly 14 which are attached to a supporting base 15. As shown, the tank 12 preferably includes a handle 17. As further shown, the tank 12 is preferably seated on top of the supporting base 15. According to an alternative preferred embodiment, multiple water tanks may alternatively be used as desired. Preferably, the supporting base 15 includes attached feet 11 (shown in FIG. 3).

With further reference to FIG. 1, the vapor blower assembly 14 may preferably further include a control surface 13 and an outlet grill 16. According to a preferred embodiment, the control surface 13 may preferably include a touch panel, control panel or the like attached to a PC board to allow a user to control operation of the humidifier 10. Preferably, the control panel/control surface 13 may be printed with appropriate graphics and may be attached to the humidifier 10 via heat stakes or the like. Preferably, the control surface 13 may further include a lens which assists in indicating the power mode of the humidifier via color changing LEDs or the like. As further shown in FIG. 2, the humidifier 10 may preferably further include an air inlet grill 18 to allow air to be fed into the vapor blower assembly 14 as discussed further below.

Figure 2:
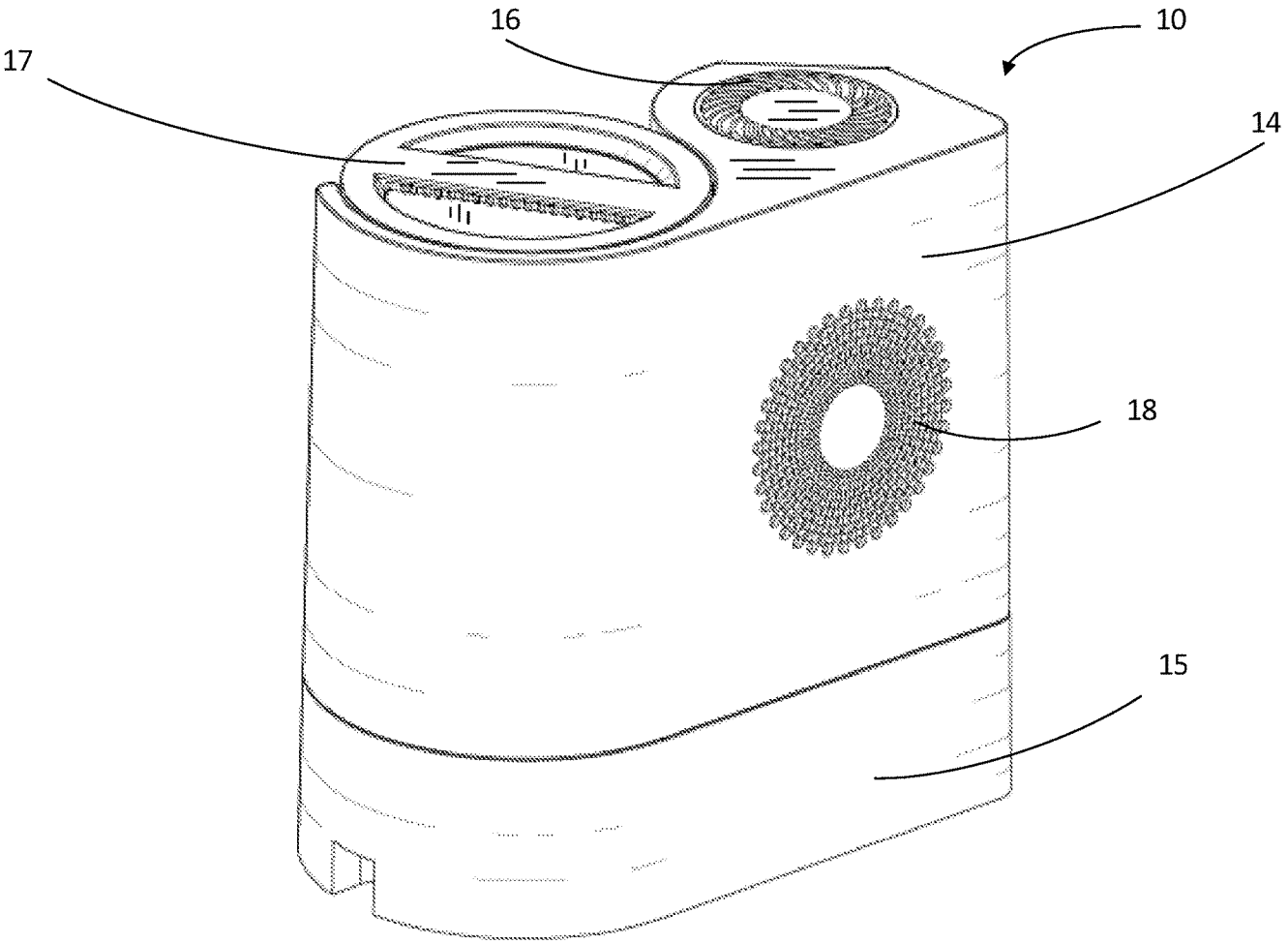
Figure 3:
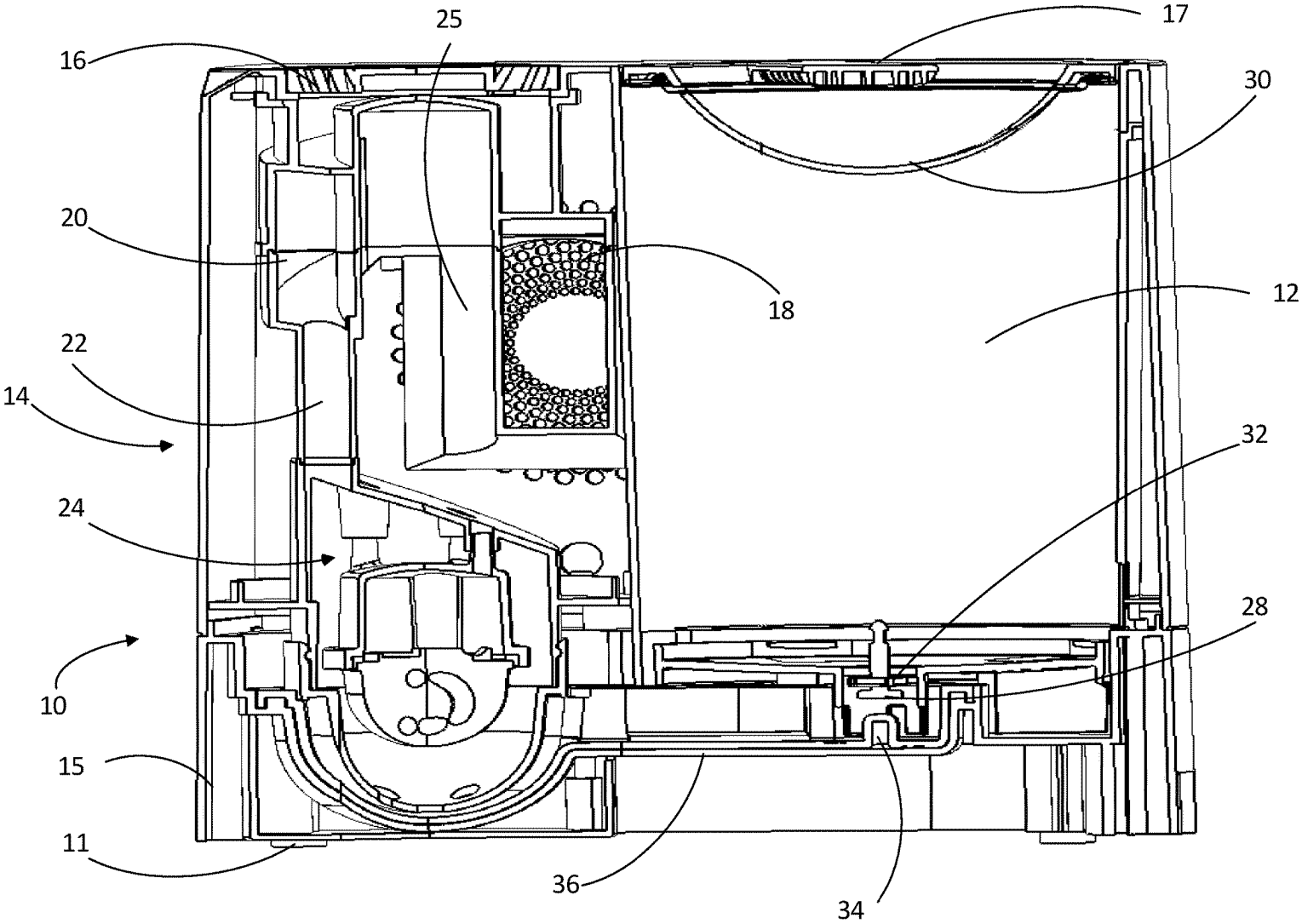
FIG. 3 shows a cross-sectional view of an exemplary humidifier in accordance with a first preferred embodiment of the present invention.

With reference now to FIG. 3, a cross-sectional view of the exemplary humidifier 10 shown in FIGS. 1 and 2 is provided. As shown, the tank 12 preferably includes a tank handle 17, a tank top 30, a valve gasket 32, a plunger 28 and a plunger contact 34. According to preferred embodiment, the tank 12 preferably provides water for the humidifier. Preferably, the tank 12 is removable and refillable. In operation, the tank 12 of the present invention is filled with water (or other liquid) and then placed onto the base 15 so that the plunger 28 is depressed by the plunger contact 34 thus opening the valve gasket 32 and allowing water to enter the water trough 36 as discussed further below.

As further shown in FIG. 3, the water within the trough 36 is preferably fed into the vapor blower assembly 14 where the water is heated and turned into steam/water vapor within a steam chamber 24. Thereafter, the steam is preferably directed via a chimney 22 to a spiral mixing chamber 20. According to a preferred embodiment, the steam in the spiral mixing chamber 20 is preferably mixed with air taken in through the air inlet 18. According to a preferred embodiment, air is pulled into the air inlet 18 via a fan (not shown) and provided to the spiral mixing chamber 20 via an inlet duct 25. The combined air/steam mixture is then preferably directed out through the outlet grill 16 as discussed further below.

Figure 4:
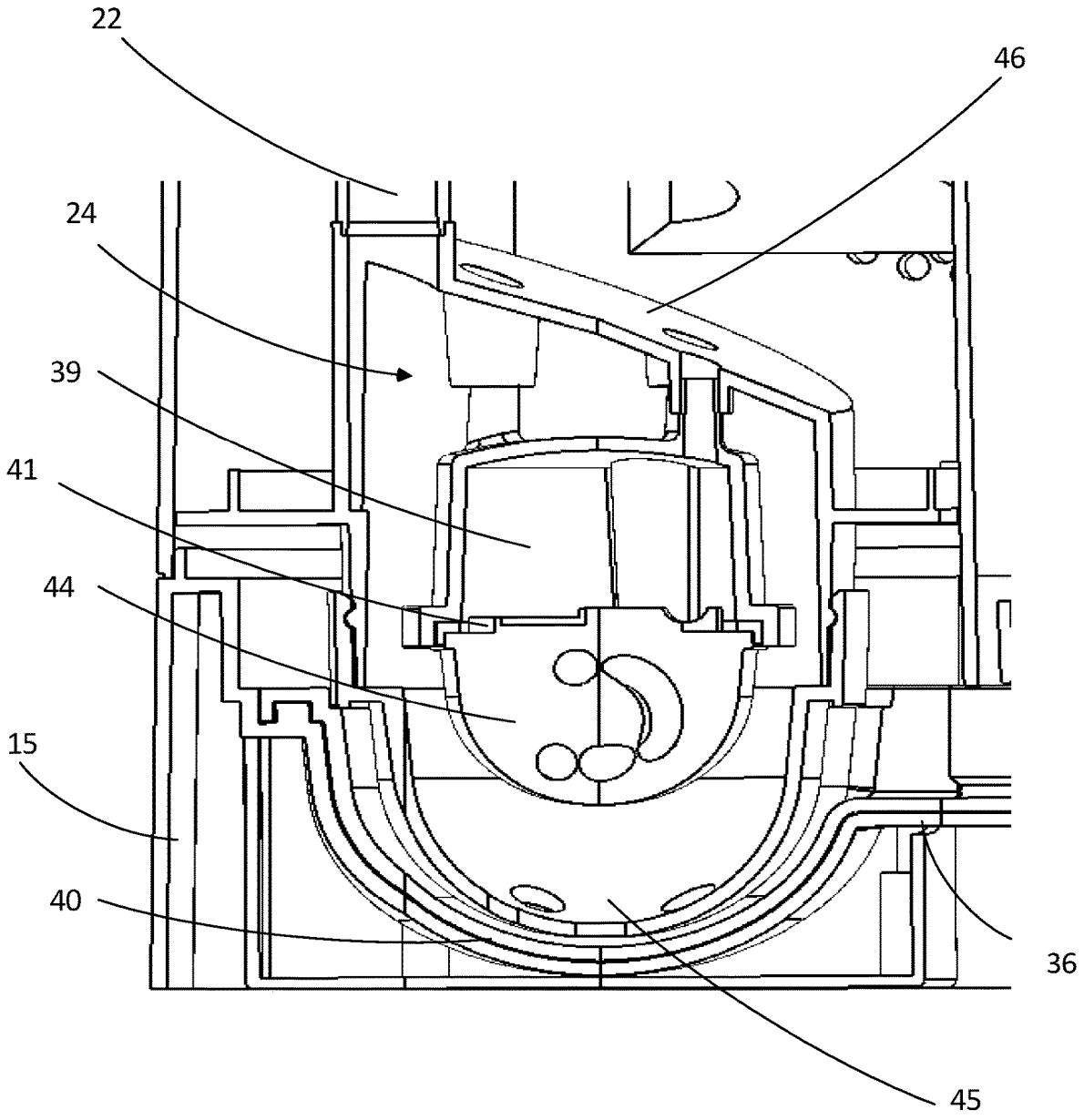
FIG. 4 shows a cross-sectional view of an exemplary steam chamber in accordance with a first preferred embodiment of the present invention.

With reference now to FIG. 4, an enlarged, cross-sectional view of an exemplary steam chamber 24 of the present invention shall now be discussed. As shown in FIG. 4, the exemplary steam chamber 24 preferably houses a boiler pod 44, a boiler pod cover 39, a bonnet 45, and a trough 36 which includes a trough reservoir 40. In a preferred method of operation, water is provided through the trough 36 and into the water trough reservoir 40 where the water is heated by the boiler pod 44. Through heating by the boiler pod 44, the water is turned into steam/water vapor which is directed into a chimney 22 or similar vent. According to a further preferred embodiment, the water vapor is preferably directed into the chimney 22 via a sloped steam chamber top 46.

According to a preferred embodiment, the boiler pod 44 may preferably be an aluminum or zinc cast part, cast around a cowl rod heating element, with the two ends of the cowl rod extending out the top for electrical connections. Further, the boiler pod 44 may preferably be coated with a non-stick surface, such as Teflon or similar coating. As shown in FIG. 4, the boiler pod 44 of the present invention may preferably be mounted/suspended above the trough reservoir 40. A preferred and unique feature of the boiler pod 44 of the present invention is the spherical design of its bottom surface. According to a preferred embodiment, water is heated to boiling temperatures by the boiler pod 44 and the rounded bottom of the boiler pod 44 preferably removes the potential for water to become super-heated. Further, the shape and positioning of the boiler pod 44 preferably reduces audible popping sounds made during heating. Preferably, a boiler pod gasket 41 is located between the boiler pod 44 and the boiler pod cover 39 to thermally isolate the two parts thus reducing heat transfer. The boiler pod cover 39 preferably supports the boiler pod 44 and preferably creates an area for electrical connections and thermal protection. Preferably, the boiler pod cover 39 keeps the electrical components (not shown) out of the path of the steam and humidity.

Figure 5:
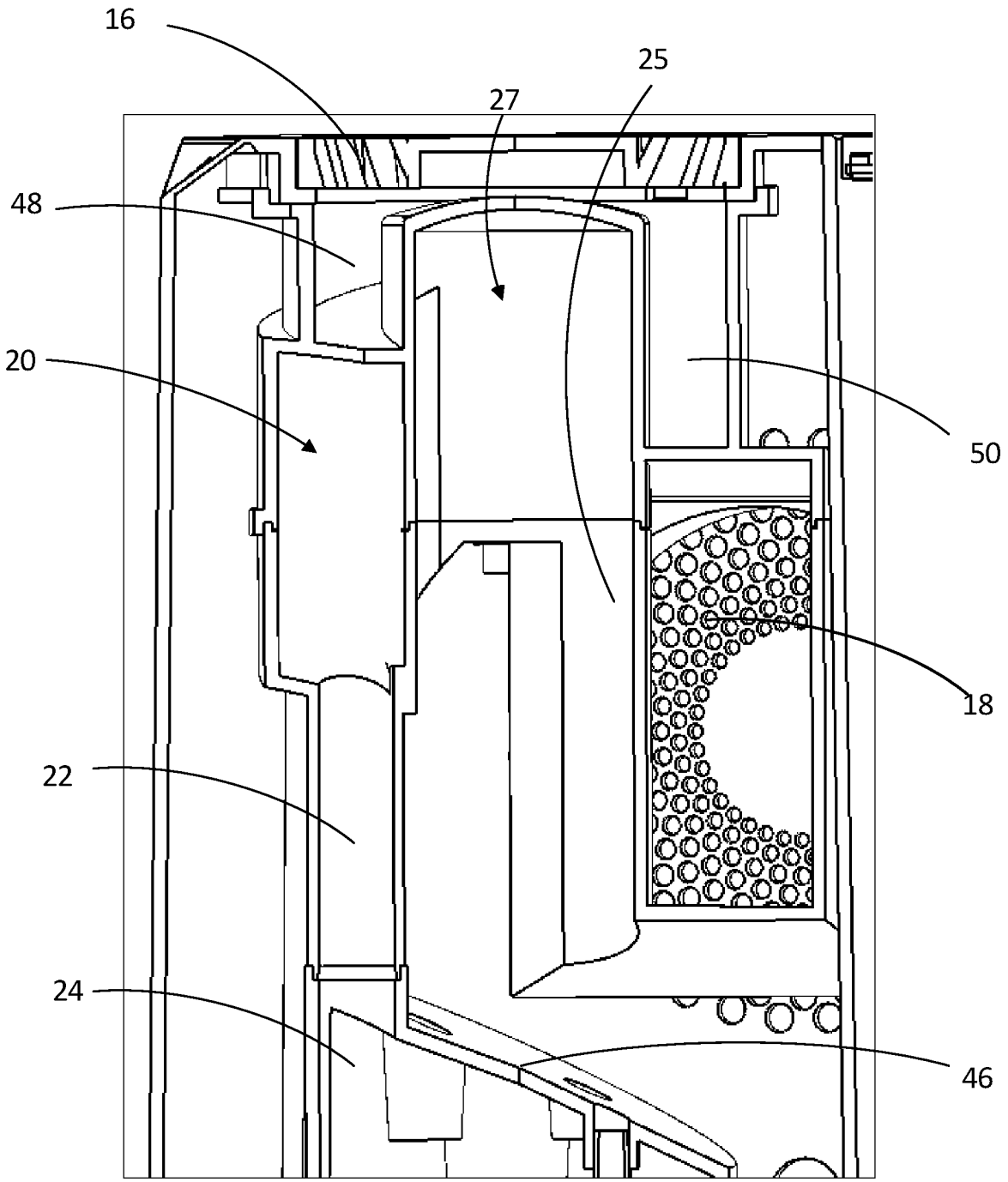
FIG. 5 shows a cross-sectional view of an exemplary chimney and spiral mixing area in accordance with a first preferred embodiment of the present invention.

With reference now to FIG. 5, an enlarged, cross-sectional view of an exemplary spiral mixing chamber 20 of the present invention shall now be discussed. As shown in FIG. 5, the spiral mixing chamber 20 of the present invention may be connected on a first side to a lower spiral ramp 50 which winds around an interior area 27 to an upper spiral ramp 48. The upper spiral ramp 48 preferably opens to an outlet grill 16 which allows the steam/air mixture to be released into a given exterior space.

In preferred steps, the steam from the chimney 22 is preferably first fed via convection/air pressure into the spiral mixing chamber 20. As shown, the spiral mixing chamber 20 is preferably connected on second side to an inlet duct 25. Accordingly, with the operation of an inlet fan (preferably a computer type fan positioned between the inlet duct 25 and the air inlet 18), outside ambient air is pulled through the air inlet 18 and combined with steam from the steam chamber 24 within the spiral mixing chamber 20. Thereafter, the combined air/steam mixture is preferably directed through the lower spiral ramp duct 50 to the upper spiral ramp duct 48 and out of the outlet grill 16. According to a preferred embodiment, the lower and upper spiral ramp ducts 48, 50 are two portions of a single, integrated spiral ramp duct which wraps around in a spiral fashion with an increasingly smaller duct dimension as the duct extends upward to the outlet grill 16.

According to a further preferred embodiment, the chimney 22 may extend slightly into the spiral ramp duct and may project up from the bottom surface of the spiral ramp duct. Further, the chimney 22 may preferably include an extension on the upwind side, which projects up from the bottom surface of the spiral ramp so that any steam condensation that is not mixed into air stream will not drip down the spiral ramp any further than the chimney opening. This configuration may further direct droplets of condensating water to freely return to the steam chamber 24. According to a still further preferred embodiment, the top surface of the spiral ramp may preferably have a slight vertical wall or curtain which extends down to cause any drips that travel down the top surface of the spiral ramp to drop down into the chimney 22 and return back to the steam chamber 24.

Figure 6:
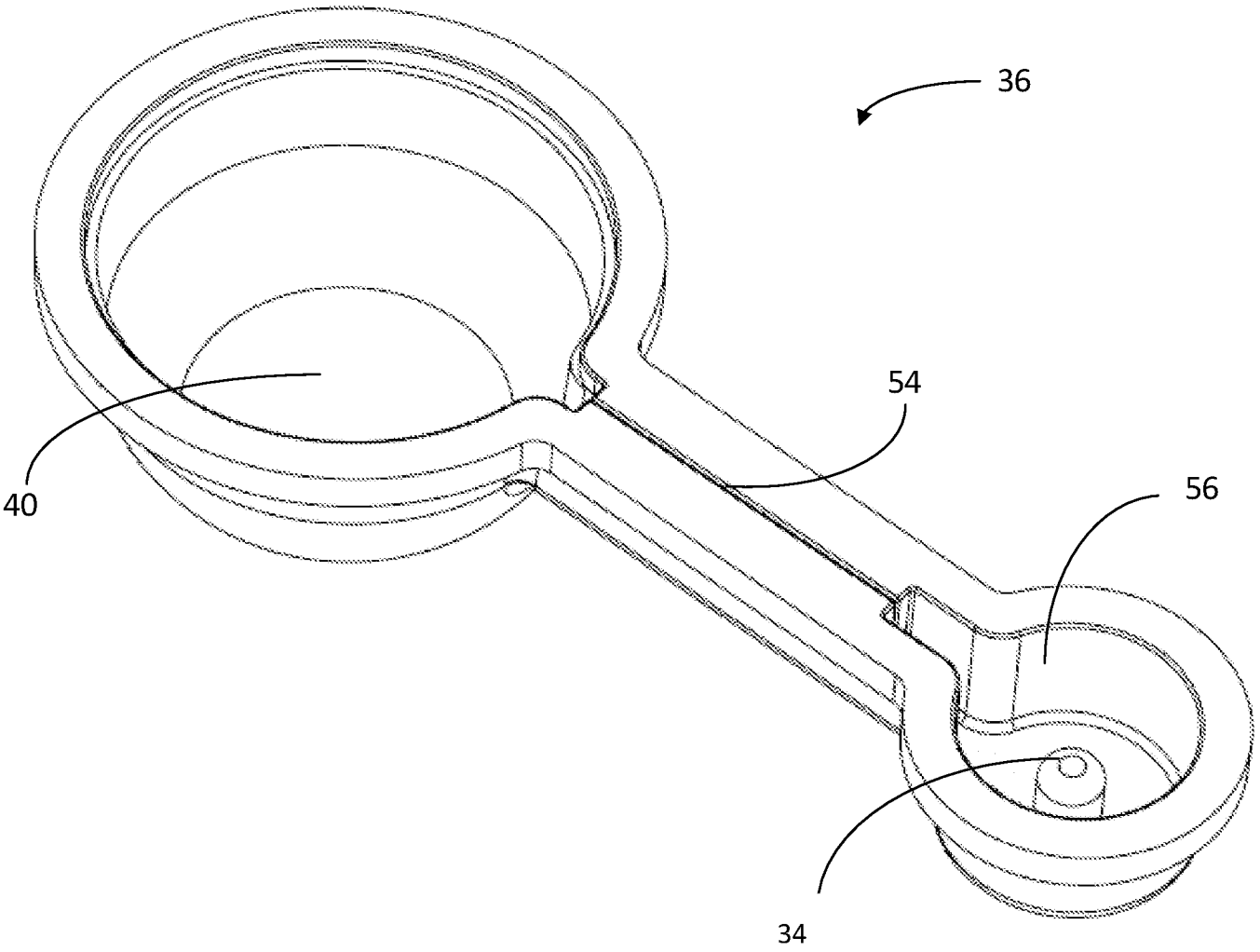
FIG. 6 shows a perspective view of exemplary trough in accordance with a first preferred embodiment of the present invention.

With reference now to FIG. 6, details of the trough 36 and trough reservoir 40 of the present shall now be further discussed. According to a preferred embodiment, the trough 36 of the present invention is preferably removable. According to a further preferred embodiment, the trough 36 is preferably made of silicon or a similar water proof material. As shown in FIG. 6, the trough 36 preferably includes a water trough inlet 56 (including a plunger contact 34), a water trough channel 54, and a trough reservoir 40. In accordance with a preferred embodiment of the present invention, the trough 36 of the present invention is preferably easily removed, flexible and inherently non-stick, to allow for the easy cleaning of calcium and other deposits. According to a further preferred embodiment, the trough 36 is preferably also heat resistant so that it may provide a heat barrier between the boiler pod 44 and other surfaces.

As shown in FIG. 6, the trough 36 is preferably designed with a narrow water trough channel 54 so that only a small amount of water can pass through the trough 36 and thus minimize heat transfer through the water from the boiler pod 44 to the tank 12 end. According to a further preferred embodiment, the trough 36 preferably further includes a full perimeter lip and a return lip that locks the trough 36 into the base 15, thus keeping the trough 36 in the proper position.

Figure 7:
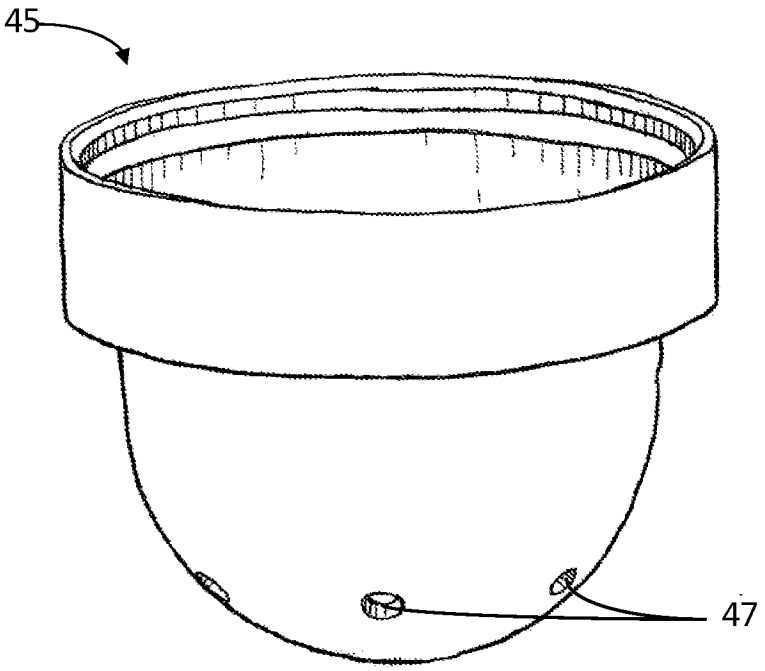
FIG. 7 shows a perspective view of a silicon bonnet in accordance with a further preferred embodiment of the present invention.

FIG. 7 shows a perspective view of a silicon bonnet 45 in accordance with a further preferred embodiment of the present invention. As shown, the bonnet 45 preferably includes one or more perforations 47 which allow water from the trough reservoir 40 to pass and gain contact with the boiler pod 44 area. As shown in FIG. 3, the bonnet 45 may preferably be positioned between the trough reservoir 40 and the boiler pod 44. According to a preferred embodiment, the bonnet 45 preferably may function as a heat shield to the boiler pod 44. In this role, the bonnet 45 preferably keeps the hottest water in close proximity to the boiler pod 44 and reduces the heat transfer to the surrounding water in the trough 36. Preferably, the bonnet 45 is made of silicon or similar material which is flexible and inherently non-stick to allow for easy removal of calcium and the like.

The foregoing description of the preferred embodiment of the present invention has been presented for the purpose of illustration and description. It is not intended to be exhaustive or to limit the invention to the precise form disclosed and many modifications and variations are possible in light of the above teachings. Accordingly, the scope of the invention is to be determined by the claims below rather than being limited to the specifically described embodiments above.

What is claimed is:

1. An air humidifying system, wherein the air humidifying system comprises:

a vapor blower assembly, wherein the vapor blower assembly comprises:

a control surface, wherein the control surface comprises a control panel;

an outlet grill;

an inlet grill, wherein the inlet grill is positioned to receive air from outside the air humidifying system; wherein the inlet grill is positioned to direct air to an inlet duct;

a water heating assembly, wherein the water heating assembly is comprised of a boiler pod, a boiler pod cover, a bonnet and a boiler pod gasket;

a steam chamber, wherein the steam chamber encloses the water heating assembly; further wherein the steam chamber further comprises a steam chamber top;

a spiral mixing chamber, wherein the spiral mixing chamber is connected on a first end to a spiral outlet duct and on a second end to the inlet duct; wherein the spiral mixing chamber is connected to the steam chamber via a chimney;

wherein the steam chamber top is upwardly sloped towards the chimney;

wherein the inlet duct directs air into the spiral mixing chamber; wherein the spiral mixing chamber is configured to combine steam from the steam chamber with air from the inlet duct to form a first steam mixture; wherein the spiral outlet duct is configured to direct the first steam mixture from the spiral mixing chamber through the spiral outlet duct and out through the outlet grill;

a water tank assembly, wherein the water tank assembly comprises a tank handle, a tank top, a valve gasket, and a plunger; wherein the water tank assembly is configured to release water to a trough; and a base assembly, wherein the base assembly is configured to support the water tank assembly and the vapor blower assembly.

2. The air humidifying system of claim 1, wherein the boiler pod comprises a bottom surface; wherein the bottom surface is rounded.

3. The air humidifying system of claim 2, wherein the boiler pod is comprised of an aluminum body cast around a cowl rod heating element.

4. The air humidifying system of claim 2, wherein the boiler pod is comprised of a zinc body cast around a cowl rod heating element.

5. The air humidifying system of claim 2, wherein the boiler pod is comprised of a cowl rod heating element.

6. The air humidifying system of claim 5, wherein the cowl rod heating element comprises a first end and a second end; wherein the first end and the second end of the cowl rod heating element each extend out from the cowl rod heating element.

7. The air humidifying system of claim 6, wherein the boiler pod further comprises a non-stick outer surface.

8. The air humidifying system of claim 6, wherein the boiler pod is suspended above the trough.

9. The air humidifying system of claim 8, wherein the boiler pod gasket is located between the boiler pod and the boiler pod cover.

10. The air humidifying system of claim 9, wherein the boiler pod gasket is positioned to thermally isolate the boiler pod from the boiler pod cover.

11. The air humidifying system of claim 10, wherein the system further comprises a lower spiral ramp duct and an upper spiral ramp duct.

12. The air humidifying system of claim 11, wherein the lower spiral ramp duct is configured to receive the first steam mixture from the spiral outlet duct.

13. The air humidifying system of claim 12, wherein the lower spiral duct and the upper spiral duct are integrally connected to form a first integrated spiral ramp duct.

14. The air humidifying system of claim 13, wherein the first integrated spiral ramp duct comprises a single spiral ramp duct which has decreasing volume as the first integrated spiral ramp duct extends upward to the outlet grill.

15. The air humidifying system of claim 14, wherein the chimney extends into the lower spiral ramp duct; wherein the chimney extends above the bottom surface of the lower spiral ramp duct.

16. The air humidifying system of claim 15, wherein the upper spiral ramp duct comprises a top surface; wherein the top surface of the upper spiral ramp duct comprises a vertical wall which extends down.

17. The air humidifying system of claim 16, wherein the trough comprises a water inlet basin configured to receive water from the water tank assembly.

18. The air humidifying system of claim 17, wherein the trough comprises a water trough channel and a trough reservoir; wherein the water trough channel is configured to direct water from the water inlet basin to the trough reservoir.

19. The air humidifying system of claim 18, wherein the trough is removable from the water tank assembly.

20. The air humidifying system of claim 19, wherein the trough is formed of flexible, non-stick material.

21. The air humidifying system of claim 20, wherein the trough is heat resistant.

22. The air humidifying system of claim 21, wherein the bonnet is positioned between the trough and the boiler pod.

23. The air humidifying system of claim 22, wherein the bonnet comprises a plurality of perforations; further wherein the bonnet is comprised of heat resistant material.

* * * * *